US006793089B1

(12) United States Patent
Kim

(10) Patent No.: US 6,793,089 B1
(45) Date of Patent: Sep. 21, 2004

(54) CAN WITH IMPROVED OPENING STRUCTURE

(75) Inventor: Namyoung Kim, Seoul (KR)

(73) Assignee: Magicpia Incorporation, Incheon (KR)

( * ) Notice: Subject to any disclaimer, the term of this patent is extended or adjusted under 35 U.S.C. 154(b) by 0 days.

(21) Appl. No.: 09/937,502

(22) PCT Filed: Mar. 29, 2000

(86) PCT No.: PCT/KR00/00273

§ 371 (c)(1),
(2), (4) Date: Sep. 27, 2001

(87) PCT Pub. No.: WO00/58158

PCT Pub. Date: Oct. 5, 2000

(30) Foreign Application Priority Data

Mar. 29, 1999 (KR) ..... 1999-10868

(51) Int. Cl.[7] ..... B65D 43/26
(52) U.S. Cl. ..... 220/263
(58) Field of Search ..... 220/268, 281, 220/266, 712, 906; 222/541.6

(56) References Cited

U.S. PATENT DOCUMENTS 3,794,206 A * 2/1974 De Line et al. ..... 220/268
4,210,256 A * 7/1980 Amberg et al. ..... 220/254.3
4,289,250 A 9/1981 Jordan
4,319,692 A 3/1982 Gundlach
4,465,203 A 8/1984 Lambert
5,346,087 A * 9/1994 Klein ..... 220/268
5,535,911 A * 7/1996 Cortez ..... 220/268
5,680,952 A * 10/1997 Chasteen ..... 220/268
6,253,946 B1 * 7/2001 Makinen ..... 220/268

FOREIGN PATENT DOCUMENTS

JP 8-104325 * 4/1996

* cited by examiner

*Primary Examiner*—Robin A. Hylton
(74) *Attorney, Agent, or Firm*—Nixon & Vanderhye PC

(57) ABSTRACT

A can (20) includes a main body (22) having a predetermined cavity (21) for storing beverage, a seal member (30) sectioned by an arch shaped notch portion (24) formed on an upper surface of the main body and having first and second inclined portions (32, 33) with respect to a support wrinkled portion (31) formed with a step, a thimble portion (34) formed at the seal member such that the support wrinkled portion adjacent to the notch portion can be vertically disposed at a central portion thereof, a wrinkled portion (35) formed at the second inclined portion and bent in a wave shape when the notch portion is destroyed, and an initial destruction portion (36) formed at a portion adjacent to the thimble portion and the notch portion for initially destroying the notch portion when the thimble portion is bent.

9 Claims, 8 Drawing Sheets

CAN WITH IMPROVED OPENING STRUCTURE

TECHNICAL FIELD

The present invention relates to a beverage containing can for distribution, and more particularly, to a can having an improved opening structure of an outlet through which the beverage flows out.

BACKGROUND ART

Liquor, health beverage, and soda beverage are sold in various types of containers. Most containers include a cavity in which liquor or beverage is stored, a main body where an inlet of the cavity is provided, and a seal member for opening/closing the inlet of the main body.

FIG. 1 shows a can which is an example of the containers. As shown in the drawing, a can 10 includes a main body 12 formed of a material such as aluminum and where a cavity is provided, a seal member 14 sectioned by a notch portion 13 on the upper surface of the main body 12 and for sealing an inlet of the cavity 11, and a ring opener 15 riveted or welded at one side of the seal member 14 and for separating the seal member 14 from the main body 12 by destroying a part of the notch portion 13 when the opener 15 pivots.

In the can 10 having the above structure, since the opener 15 is in close contact with the upper surface of the main body 12, and since the notch portion 13 connecting the seal member 14 and the main body 12 is destroyed at the initial pivot of the opener 15, a great initial force for pivoting the opener is needed. Thus, pivoting the opener 15 is difficult for aged or weak persons, or kids. Also, women having long finger nails may have her nails damaged while pivoting the opener 15.

Also, the seal member 14 sectioned by the notch portion 13 occupies a small area in the can. Thus, as the opener 15 and the seal member 14 are completely separated from the main body 12 and lost, valuable resources cannot be recycled.

DISCLOSURE OF THE INVENTION

To solve the above problems, it is an object of the present invention to provide a can having an improved structure so that the seal member can be detached from the main body by a relatively less force and the seal member is not completely separated from the main body, so that resources can be recycled.

It is another object of the present invention to provide a can having a simple structure so that productivity in manufacturing can be improved.

Accordingly, to achieve the above objects, there is provided a can comprising a main body having an inside cavity, a seal member sectioned by an arc shaped notch portion formed on an upper surface of the main body, a thimble portion formed at the seal member adjacent to the notch portion, and a wrinkled portion formed at the seal member to be bent in a wave shape when the notch portion of the main body is destroyed.

It is preferred in the present invention that the can further comprises an initial destruction portion formed near the thimble portion for initially destroying the notch portion when the thimble portion is bent, that the initial destruction portion is formed by making the outer circumferential surface of the thimble portion sharply bent toward the notch portion at the boundary portion between the thimble portion and the seal member, and that the notch portion adjacent to the initial destruction portion is formed to be deeper than the nearby notch portion.

Also, to achieve the above objects, there is provided a can comprising a main body having a predetermined cavity for storing beverage, a seal member sectioned by an arch shaped notch portion formed on an upper surface of the main body and having first and second inclined portions with respect to a support wrinkled portion formed with a step, a thimble portion formed at the seal member such that the support wrinkled portion adjacent to the notch portion can be vertically disposed at a central portion thereof, a wrinkled portion formed at the second inclined portion and bent in a wave shape when the notch portion is destroyed, and an initial destruction portion formed at a portion adjacent to the thimble portion and the notch portion for initially destroying the notch portion when the thimble portion is bent It is preferred in the present invention that a skirt portion is formed between an edge of the first and second inclined portions and the main body, and that a beverage flow guiding portion is formed around the notch portion on the upper surface of the main body.

Also, to achieve the above objects, there is provided a can comprising a main body having a cavity for storing beverage, a seal member sectioned by an arc shaped notch portion formed on an upper surface of the main body, a protruding tab formed at the seal member adjacent to the notch portion, and a wrinkled portion formed around the protruding tab to be bent when the notch portion is destroyed as the protruding tab is bent.

Also, to achieve the above objects, there is provided a can comprising a main body having a cavity for storing beverage, a seal member sectioned by an arc shaped notch portion formed on the upper surface of the main body, at least a pair of protruding tabs formed at the seal member, and a boundary notch portion formed between the protruding tabs.

Also, to achieve the above objects, there is provided a can comprising a main body having a cavity for storing beverage, a protruding tab disposed at the center of a circular beading portion formed on an upper surface of the main body, a central notch portion formed around the protruding tab, and a circular notch portion connected to the central notch portion and separated at a predetermined distance and having an opening on the upper surface of the main body.

Also, to achieve the above objects, there is provided a can comprising a main body having a cavity for storing beverage, a pressed tab formed by pressing a protruding portion formed by beading in a circular shape on the upper surface of the main body, and a circular notch portion connected to a central notch portion formed around the pressed tab and the central notch portion and forming an opening on the upper surface of the main body when being cut.

BEST MODE FOR CARRYING OUT THE INVENTION

Figure 1:
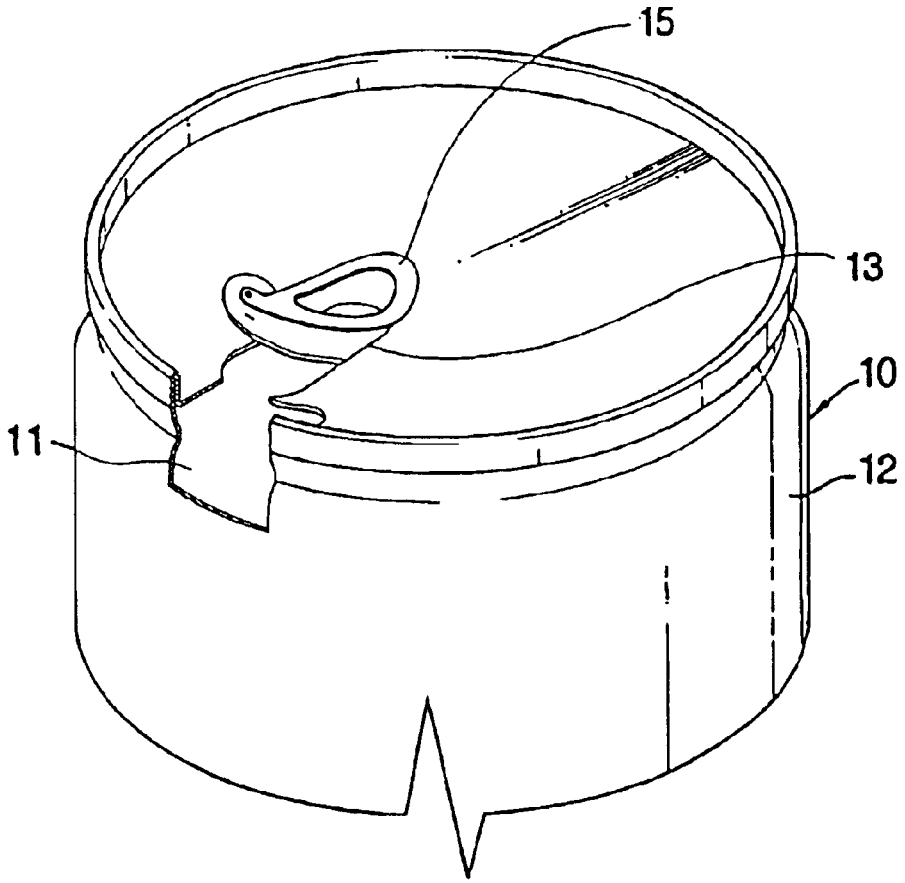
FIG. 1 PRIOR ART
FIG. 1 is a partially cut-away perspective view showing a conventional can.
Figure 2:
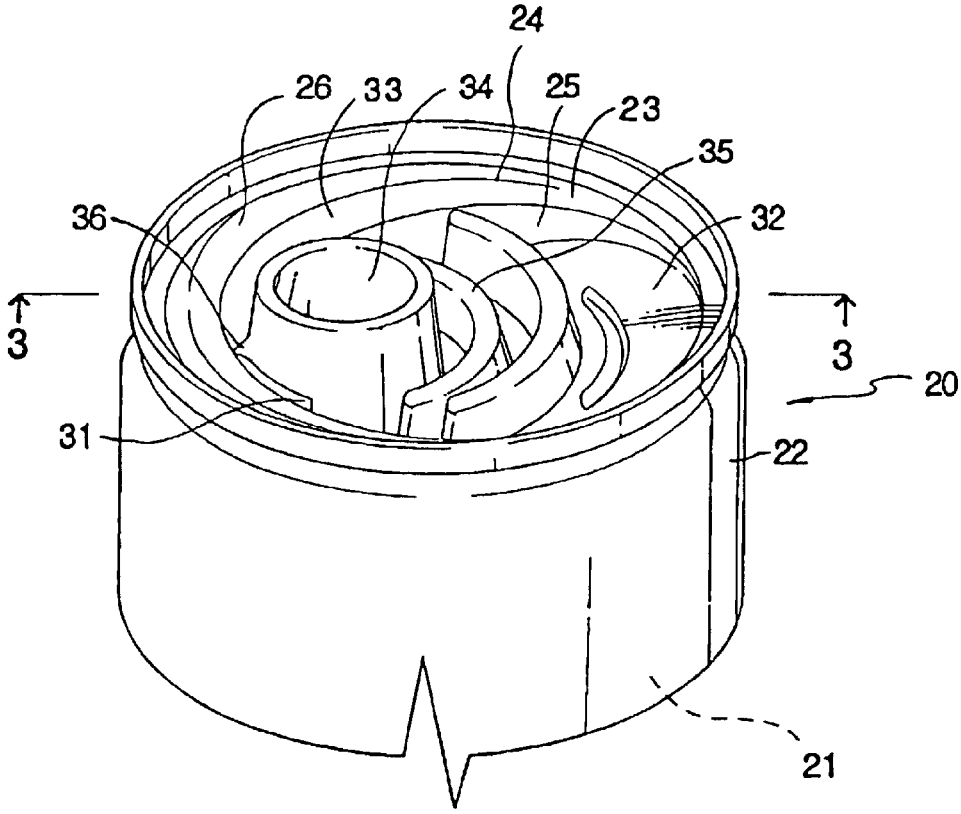
FIG. 2 is a perspective view showing a can according to a first preferred embodiment of the present invention.
Figure 3:
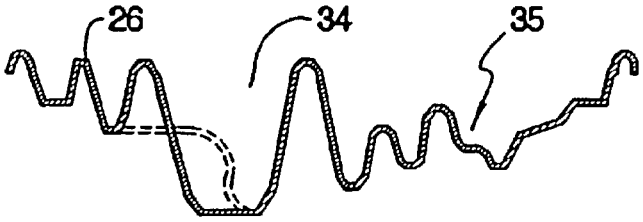
FIG. 3 is a sectional view taken along lines 3—3 of FIG. 2.
Figure 4A:
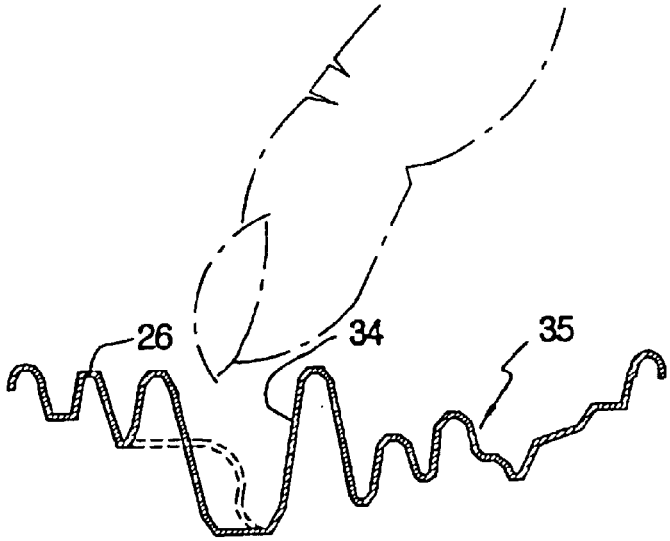
FIGS. 4A through 4D are sectional views showing the states in which the thimble portion and the wrinkled portion are bent and the seal member is separated from the main body in a can according to a first preferred embodiment of the present invention.
Figure 4B:
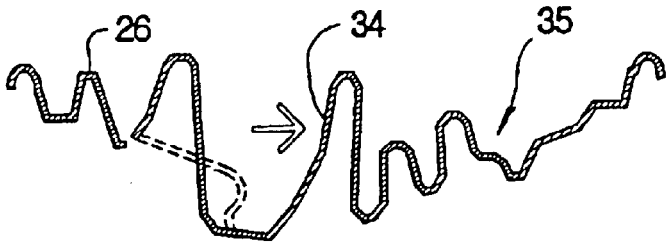
Figure 4C:
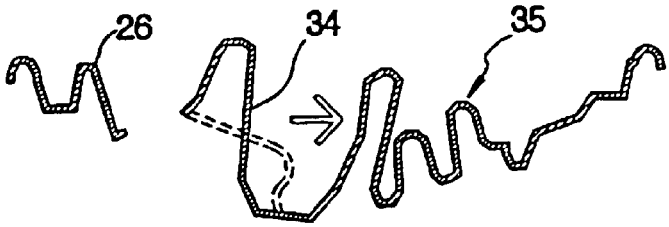
Figure 4D:
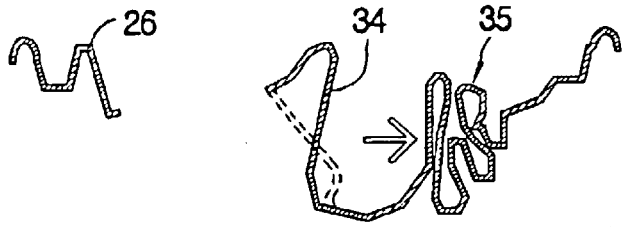

FIG. 2 is a perspective view showing a can according to a first preferred embodiment of the present invention. FIG. 3 is a sectional view taken along lines 3—3 of FIG. 2.

As shown in the drawings, a can 20 includes a main body 22 having a cavity 21 inside and a seal member 30 having a plurality of arc shaped or circular notch portions 24 formed and sectioned on the upper surface 23 of the main body 22. First and second inclined portions 32 and 33 are formed with respect to a support wrinkled portion 31 on the seal member 30. A skirt portion 25 is formed between the upper portion 23 of the main body 22 and the first and second inclined portions 32 and 33 of the seal member 30. A thimble portion 34 is vertically formed at the central portion of the support wrinkled portion 31 on the seal member 30. A wrinkled portion 35 having a wave shape is formed at the second inclined portion 33 so that the second inclined portion 33 of the seal member is bent in a wave shape as the notch portion 24 is destroyed during the banding of the thimble portion 34. Here, the thimble portion 34 and the wrinkled portion 35 are formed by beading-processing the seal member 30. An initial destruction portion 36 is formed at the thimble portion 34 near the notch portion 24 so that the notch portion is partially and initially destroyed when the thimble portion 34 is bent. The initial destruction portion 36 is formed by sharply protruding from the thimble portion 34 to the notch portion 24. The notch portion 24 near the initial destruction portion 36 is preferably formed to be deeper than the depth of the notch portion there around. The upper surface 23 of the main body and the notch portion 24 is preferably formed to be inclined by a predetermined angle toward the wrinkled portion 35.

A beverage flow guiding portion 26 is formed to protrude by being beading-processing the upper surface of the main body 22 around the notch portion of the upper surface 23 of the main body. The shape of the beverage flow guiding portion is not limited to the above embodiment and can be modified into various shapes. Also, in the above embodiment, the size of the seal member which is formed on the upper surface of the main body by being sectioned by the notch portion can be arbitrarily adjusted in an area of the upper surface of the main body.

The operation of the can 20 according to the present invention having the above structure will now be described as follows.

First, to drink e beverage stored in the cavity 21, a finger is inserted in the n (thimble portion 34 and a force is applied toward the wrinkled portion 35. As shown in FIGS. 4A through 4D, a bending moment is applied to the thimble portion 34 with respect to the support wrinkled portion 31 and thus the thimble portion 34 pivots toward the wrinkled portion 35. Thus, part of the notch portion 24 is slightly open by the initial destruction portion 36 formed at the thimble portion 34. When force is applied more to the thimble portion 34 in this state, the notch portion 24 is continuously cut and the cavity 21 is disclosed and the wrinkled portion 35 is bent. Here, since the wrinkled portion 35 is formed at the second inclined portion of the seal member 30, baing bending the wrinkled portion 35 can be smoothly performed with a small force.

Figure 5:
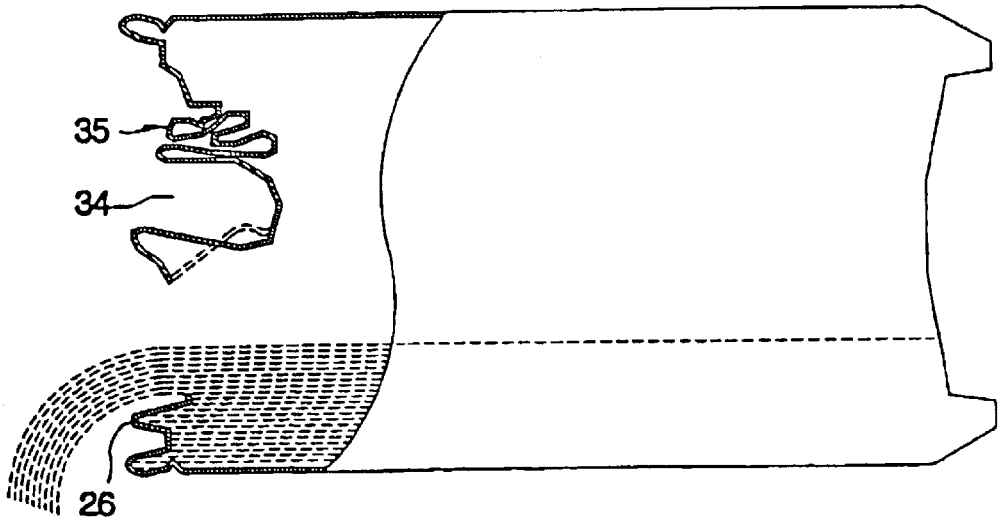
FIG. 5 is a sectional view showing the operation of the beverage flow guiding portion in the can according to the first preferred embodiment of the present invention.

When the cavity 21 of the main body 22 is open and the can 20 is inclined to pour the beverage from the can, since the beverage flow guiding portion 26 is formed around the open inlet, the beverage stored in the can flows not touching the outside comer of the main body 22, as shown in FIG. 5.

Figure 6:
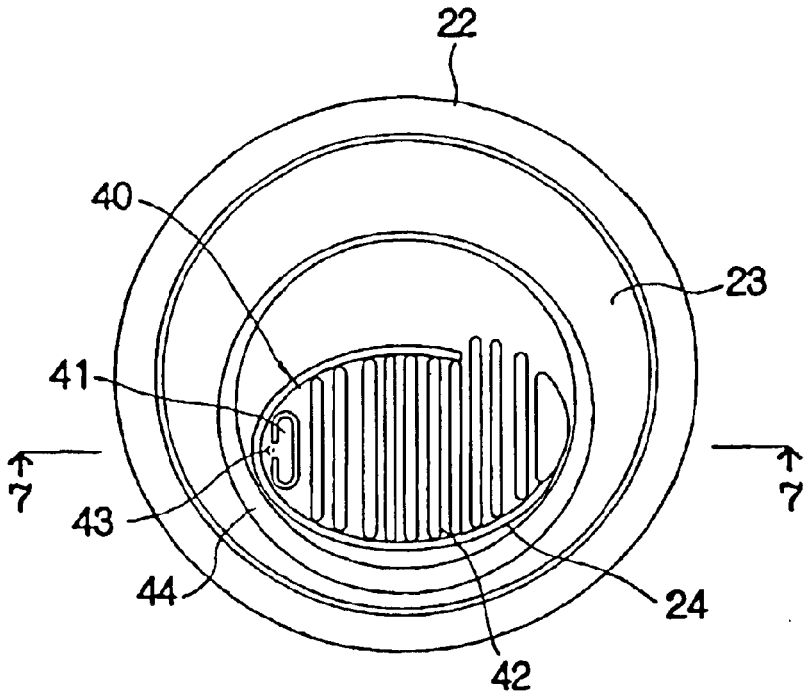
FIG. 6 is a plan view showing a can according to a second preferred embodiment of the present invention.
Figure 7:
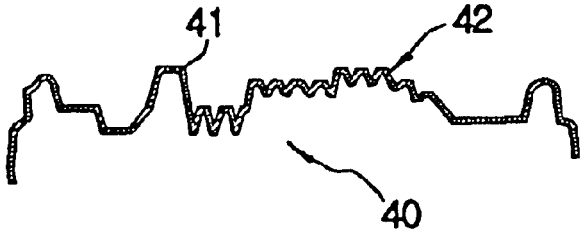
FIG. 7 is a sectional view taken along lines 7—7 of FIG. 6.

FIG. 6 is a plan view showing a can according to a second preferred embodiment of the present invention. FIG. 7 is a sectional view taken along lines SUB 7—7 of FIG. 6.

As shown in the drawings, the can includes a seal member 40 sectioned by the arc shaped or circular notch portion 24 formed on the upper surface 23 of the main body 22, a protruding tab 41 formed at the seal member 40 adjacent to the notch portion 24, and a wrinkled portion 42 formed around the protruding tab 41 to be cut according to the notch portion which is cut by pivoting of the protruding tab 41. The protruding tab 41 and the wrinkled portion 42 are integrally formed with the seal member 40 by beading-processing the seal member 40. An initial destruction portion 43 for initially guiding the destruction of the notch portion when the protruding tab 41 pivots is formed at the protruding tab 41. A beverage flow guiding portion 44 is formed around the notch portion 24 on the upper surface of the main body. Since the structures of the initial destruction portion 43 and the beverage flow guiding portion 44 are the same as those in the above embodiment, the description thereof will be omitted.

When the protruding tab 41 is pushed toward the wrinkled portion 42 in the can having the above structure, the notch portion is initially cut by the integrally formed initial destruction portion 43. In this state, when an external force is further applied to the protruding portion 41 toward the wrinkled portion 42, the wrinkled portion 42 is bent and the cavity is disclosed, so that a user can drink the beverage stored in the cavity.

Figure 8:
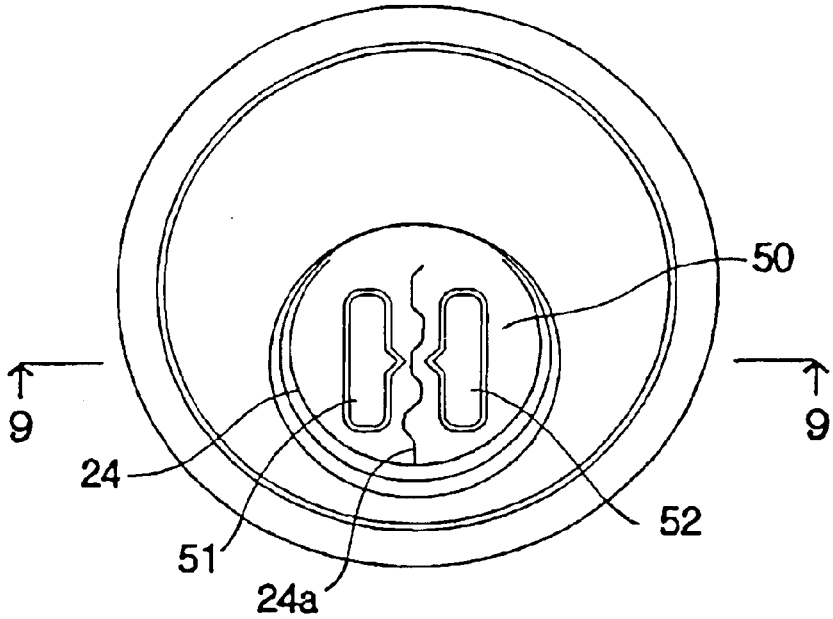
FIG. 8 is a plan view showing a can according to a third preferred embodiment of the present invention.
Figure 9:
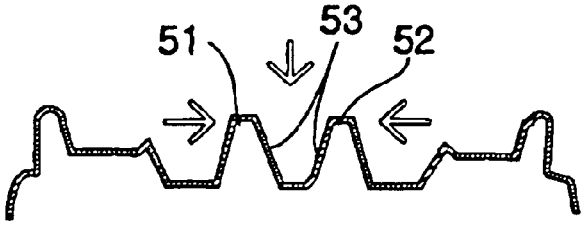
FIG. 9 is a sectional view taken along lines 9—9 of FIG. 8.

FIG. 8 is a plan view showing a can according to a third preferred embodiment of the present invention. FIG. 9 is a sectional view taken along lines 9—9 of FIG. 8.

As shown in the drawings, the can includes at least a pair of protruding tabs 51 and 52 at a seal member 50 sectioned by the arc shaped or circular notch portion 24 formed on the upper surface 23 of the main body 22, and a boundary notch portion 24*a* is formed between the protruding tabs 51 and 52. An initial destruction portion 53 for initially destroying and cut the boundary notch portion when the protruding tabs 51 and 52 are bent is further provided at the sides of the protruding tabs 51 and 52 facing each other.

In the can having the above structure, when the protruding tabs 51 and 52 are strongly pressed by the fingers of a user toward each other, the protruding tabs 51 and 52 fell in directions facing each other and the boundary notch portion 24*a* is destroyed. Thus, the cavity 21 of the main body is disclosed so that the user can drink the beverage stored in the cavity.

Figure 10:
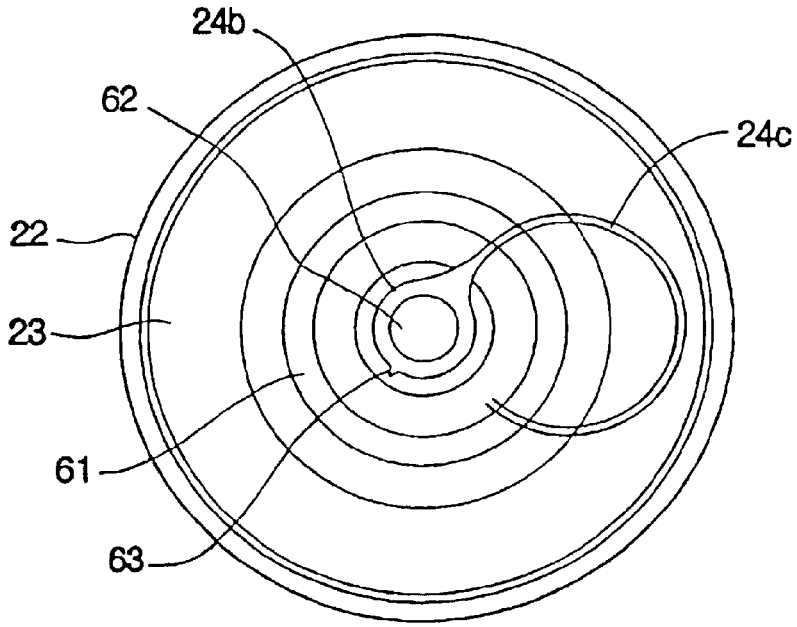
FIG. 10 is a plan view showing a can according to a fourth preferred embodiment of the present invention.
Figure 11:
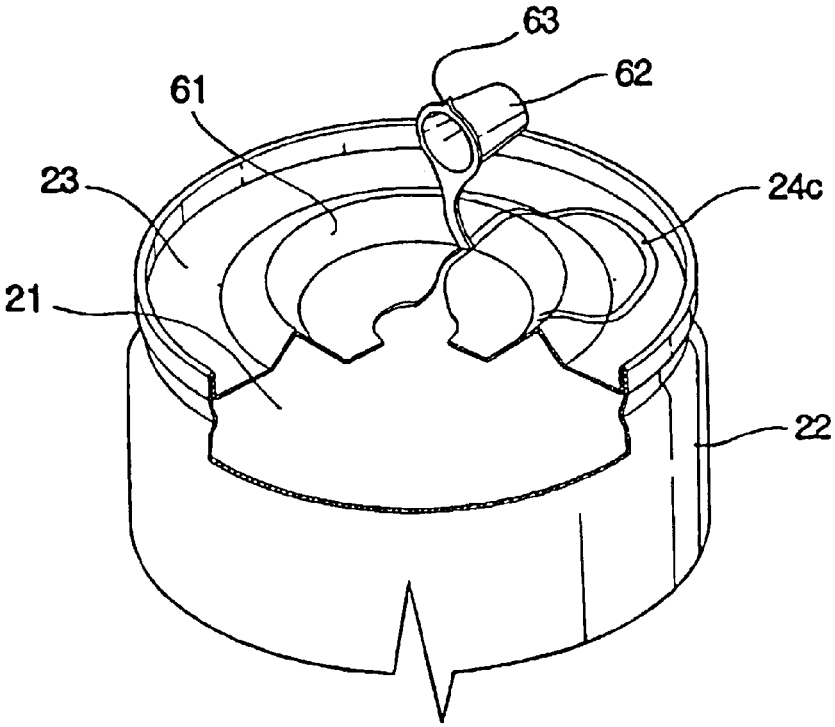
FIG. 11 is a perspective view showing the state in which the can according to the fourth preferred embodiment of the present invention is in use.

FIG. 10 is a plan view showing a can according to a fourth preferred embodiment of the present invention. FIG. 11 is a perspective view showing the state in which the cavity is open.

As shown in the drawings, a circular beading portion 61 is formed on the upper surface of the main body 22 having the cavity 21 in which beverage are stored. At least one protruding tab 62 sectioned by a central notch portion 24*b* is formed at the central portion of the beading portion 61. A circular notch portion 24*c* connected to the central notch portion 24*b* and separated a predetermined distance so as to form an opening when the notch portion on the upper surface of the main body is cut, is formed. An initial destruction portion 63 is further provided at the protruding tab 62.

In the can having the above structure, the central notch portion 24*b* is cut by pushing the protruding tab to one side and the circular notch portion 24*c*is cut by pulling the cut protruding tab 62. Here, since the circular notch portion 24*c* forms a closed circuit having an opening, when the circular notch portion 24*c* is cut, the upper surface of the main body 22 is partially cut. In this state, the cavity is open by pushing the cut upper surface toward the cavity of the main body.

Figure 12:
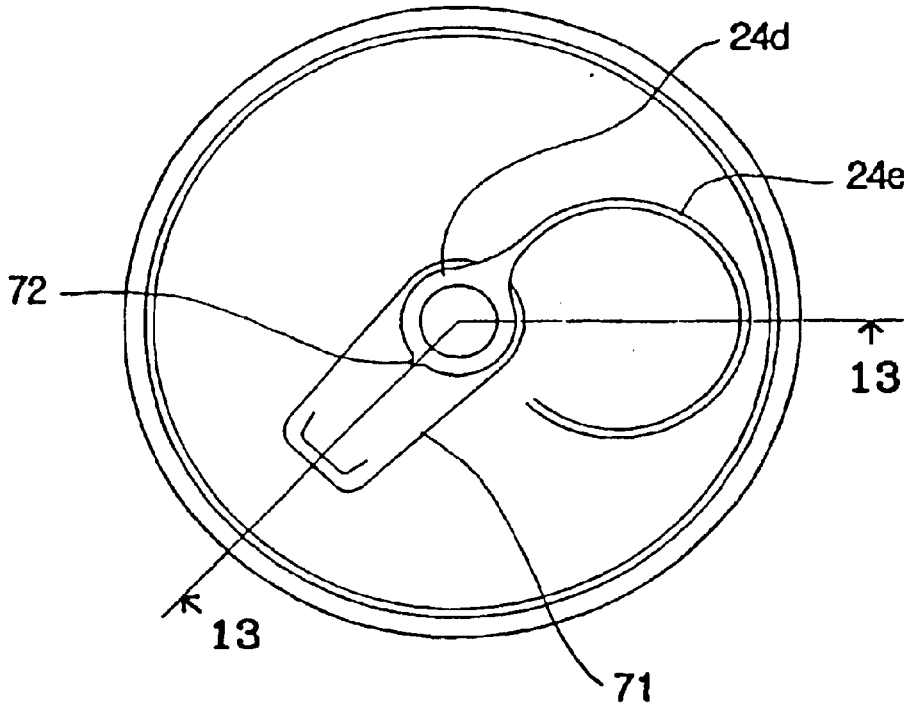
FIG. 12 is a plan view showing a can according to a fifth preferred embodiment of the present invention.
Figure 13:
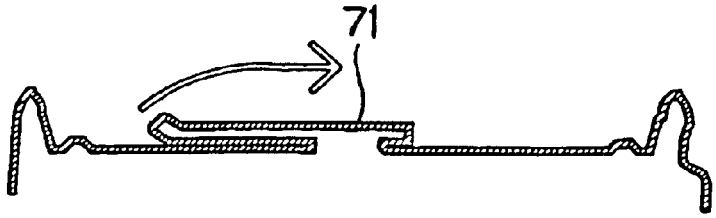
FIG. 13 is a sectional view taken along lines 13—13 of FIG. 12.

FIG. 12 is a plan view showing a can according to a fifth preferred embodiment of the present invention.

As shown in the drawing, a pressed tab 71, of which the upper surface is formed by a circularly beading and pressing method, is formed on the upper surface of the main body 22 having the cavity 21where beverage are contained. The pressed tab 71 preferably has an extension portion 72 extended a predetermined length from a base portion of the main body. A central notch portion 24*d* is formed around a base portion of the pressed tab on the upper surface of the main body. A circular notch portion 24*e* connected to the central notch portion and forming an opening by being cut is formed on the upper surface of the main body. The pressed tab 71 is further provided with an initial destruction portion 72.

In the can having the above structure, the pressed tab 71 pivots to cut the central notch portion 24*d*. As the central notch portion 24*d* is cut, the separated pressed tab 71 is pulled to cut the circular notch portion 24*e*. Here, since the circular notch portion 24*e* forms a closed circuit having an opening, when the circular notch portion 24*e* is cut, part of the upper surface of the main body 22 is cut. In this state, the cavity is open by pushing the cut upper surface toward the cavity of the main body.

Industrial Applicability

The cans according to the above preferred embodiments have the following advantages.

First, since the thimble portion, the protruding tab, or the pressed tab is formed on the upper surface of the main body and these pivot by a small force, the notch portion is destroyed and the wrinkled portion formed at the seal member is bent so that the cavity is open.

Second, since the thimble portion protects the finger of a user, the damage to the finger nails generated when the user pivots the tab can be prevented.

Third, since the opening of the cavity can be formed to be large, the flow of beverage in the cavity is smooth. Also, since the beverage flow guiding portion is formed around the opening, the beverage do not touch the corner of the main body so that a sanitary state can be maintained.

Fourth, since a small ring (a tab opener) formed on the upper surface of the main body to open the cavity of the can is not needed, the structure of the can is simple and productivity in manufacturing can be improved.

It is noted that the present invention is not limited to the preferred embodiment described above, and it is apparent that variations and modifications by those skilled in the art can be effected within the spirit and scope of the present invention defined in the appended claims.

What is claimed is:

1. A can comprising:

a main body having an inside cavity;

a seal member sectioned by an arc shaped notch portion formed on an upper surface of the main body, a recessed thimble portion formed at the seal member and having a first side adjacent to and near said notch portion;

a wrinkled portion formed at the seal member near a second side of said thimble portion on opposite to said first side, said wrinkled portion being constructed to be bent in a wave shape when said notch portion of the main body is destroyed by lateral movement of said thimble portion away from said notch portion and toward said wrinkled portion to provide an opening in said seal member through which the contents of said main body can be dispensed without further manipulation of said seal member.

2. The can of claim 1, further comprising an initial destruction portion formed near the thimble portion for initially destroying the notch portion when the thimble portion is bent laterally away from said notch portion.

3. The can of claim 2, wherein said initial destruction portion is formed by making the outer circumferential surface of said thimble portion sharply bent toward said notch portion at a boundary portion between said thimble portion and the seal member.

4. The can of claim 1, further comprising a support wrinkled portion formed by stepping the seal member around said thimble potion.

5. The can of claim 1, wherein a beverage flow guiding portion is formed on the upper surface of the main body adjacent to said notch portion on the first side thereof opposite to said thimble portion.

6. A can comprising:

a main body having a predetermined cavity for storing beverage;

a seal member sectioned by an arch shaped notch portion formed on an upper surface of the main body and having first and second inclined portions with respect to a support wrinkled portion formed with a step;

a recessed thimble portion formed at the seal member near said notch portion such that the support wrinkled portion adjacent to the notch portion can be vertically disposed at a central portion thereof;

a second wrinkled portion formed at the second inclined portion and bent in a wave shape when the notch portion is destroyed by lateral movement of the thimble portion away from the notch portion and toward the second wrinkled portion to provide an opening in said seal member through which a beverage in said main body can be dispensed without further manipulation of said seal member; and an initial destruction portion formed adjacent to the thimble portion and the notch portion for initially destroying the notch portion when the thimble portion is bent laterally away from the notch portion.

7. The can of claim 6, wherein a skirt portion is formed between an edge of the first and second inclined portions and the main body.

8. The can of claim 6, wherein a beverage flow guiding portion is formed around the notch portion on the upper surface of the main body.

9. The can of claim 1 wherein said wrinkled portion is formed at an inclined portion of the seal member to facilitate lateral movement of said thimble portion.

* * * * *